US006971859B2

(12) United States Patent
Yamamoto et al.

(10) Patent No.: US 6,971,859 B2
(45) Date of Patent: Dec. 6, 2005

(54) DIAPHRAGM UNIT

(75) Inventors: Shinya Yamamoto, Kariya (JP); Satoru Kuramoto, Kariya (JP); Mamoru Kuwahara, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/997,355

(22) Filed: Nov. 24, 2004

(65) Prior Publication Data

US 2005/0118042 A1 Jun. 2, 2005

(30) Foreign Application Priority Data

Nov. 28, 2003 (JP) ..... P2003-400841

(51) Int. Cl.[7] ..... F04B 43/06
(52) U.S. Cl. ..... 417/395
(58) Field of Search ..... 417/395, 413.1; 92/96; 138/26; 220/723

(56) References Cited

U.S. PATENT DOCUMENTS 3,947,156 A * 3/1976 Becker ..... 417/437
4,634,430 A * 1/1987 Polaschegg ..... 604/141
5,145,336 A * 9/1992 Becker et al. ..... 417/413.1
5,669,764 A * 9/1997 Behringer et al. ..... 417/395
6,019,135 A * 2/2000 Onishi ..... 138/30
6,098,991 A * 8/2000 Onishi ..... 277/634
6,106,245 A * 8/2000 Cabuz ..... 417/322

FOREIGN PATENT DOCUMENTS

JP 11-62771 3/1999
JP 11-280598 10/1999

* cited by examiner

*Primary Examiner*—Timothy S. Thorpe
*Assistant Examiner*—Christopher H Orders
(74) *Attorney, Agent, or Firm*—Morgan & Finnegan, LLP

(57) ABSTRACT

A diaphragm unit includes a diaphragm and a diaphragm case. The diaphragm has a center point and an outer peripheral portion. The diaphragm case includes a fixing surface and a regulating surface. The fixing surface supports the diaphragm at the outer peripheral portion thereof, thereby defining a fluid chamber in the diaphragm case. The regulating surface forms an inner surface of the fluid chamber, thereby providing a limit of deformation of the diaphragm. The regulating surface has a convex surface region and a concave surface region. The convex surface region is formed continuously with the fixing surface for supporting the diaphragm at a portion thereof adjacent to the outer peripheral portion. The concave surface region is formed continuously with the convex surface region for supporting the diaphragm at a portion thereof adjacent to the center point. Curvatures of the convex and concave surface regions are the same.

4 Claims, 1 Drawing Sheet

DIAPHRAGM UNIT

BACKGROUND OF THE INVENTION

The present invention relates to a diaphragm unit such as diaphragm pump or diaphragm damper.

An internal combustion engine, for example, in which fuel is injected into a cylinder of the engine is equipped with a pulsation reduction unit such as a diaphragm damper (or accumulator), for stabilizing the fuel injection by reducing the pulsation of fuel being fed by a high pressure pump. Such diaphragm pump is disclosed by Japanese Unexamined Patent Publication No. 11-62771 (refer to FIGS. 2 through 4 thereof).

In the above-cited diaphragm damper, the diaphragm is supported at the outer peripheral portion thereof by fixing surfaces (or joint surfaces) of the damper case. A fluid chamber and a back pressure chamber are formed in the damper case with the diaphragm as a boundary therebetween. To the fluid chamber is connected a fuel passage extending between a high pressure pump and a cylinder. The back pressure chamber is filled airtightly with a high pressure gas. If pulsation occurs in the fuel being fed by the pump, the diaphragm is deformed, and the fuel flows in and out of the fluid chamber, with the result that the pressure pulsation of the fuel is reduced and the injection of the fuel in the cylinder is stabilized.

The damper case has formed therein a regulating surface which forms an inner surface of the fluid chamber and defines a limit of the deformation of the diaphragm. For example, if the boundary between the regulating surface and the fixing surface is angled, the deformed diaphragm contacts the angled boundary at an angle of deflection thereby reducing the durability of the diaphragm.

Thus, the regulating surface of the diaphragm damper of the above-cited publication has a convex surface region which is formed continuously with the fixing surface and supports the diaphragm at a portion thereof adjacent to the outer peripheral portion and a concave surface region which is formed continuously with the convex surface region and supports the diaphragm at a portion thereof adjacent to the center point. By so forming the regulating surface, contact of the diaphragm at an angle with the boundary between the fixing surface and the regulating surface (or the convex surface region) can be prevented and, additionally, the diaphragm deformed to its permissible limit can be safely supported by the entirety of the regulating surface. Therefore, the deformation of the diaphragm with an angle of deflection is prevented, so that a plastic deformation of the diaphragm is prevented and the durability of the diaphragm is improved.

It is noted that the diaphragm unit is not limited to the diaphragm damper, but a diaphragm pump is included in the diaphragm unit. The diaphragm pump has a structure for positively increasing and decreasing the pressure in the back pressure chamber, in addition to the structure of the above-mentioned diaphragm damper. The diaphragm pump draws or discharges fluid into or out of the fluid chamber by positively increasing and decreasing the pressure in the back pressure chamber so as to deform the diaphragm and hence change the volume of the fluid chamber. The durability of the diaphragm of such diaphragm pump is improved by providing a regulating surface which is formed by the convex and concave surface regions as described above.

However, the above-described prior art does not necessarily eliminate every factor affecting the durability of the diaphragm.

If either of the convex surface region and the concave surface region has a larger curvature radius than the other, a part of the diaphragm which contacts one curved surface region is bent with a greater curvature radius than the other part of the diaphragm. Therefore, stress caused by bending moment is unevenly applied to the diaphragm, thereby reducing the durability of the diaphragm. The above-cited prior art does not refer to any suitable values for the curvature radii of the convex surface region and the concave surface region.

SUMMARY OF THE INVENTION

The present invention is directed to a diaphragm unit which pursues a further improvement of the durability of a diaphragm in the diaphragm unit.

The present invention provides the following first feature. A diaphragm unit includes a diaphragm and a diaphragm case. The diaphragm has a center point and an outer peripheral portion. The diaphragm case includes a fixing surface and a regulating surface. The fixing surface supports the diaphragm at the outer peripheral portion thereof, thereby defining a fluid chamber in the diaphragm case. Inflow of fluid into the fluid chamber and outflow of the fluid from the fluid chamber are accomplished as the diaphragm is deformed. The regulating surface forms an inner surface of the fluid chamber, thereby providing a limit of deformation of the diaphragm. The regulating surface has a convex surface region and a concave surface region. The convex surface region is formed continuously with the fixing surface for supporting the diaphragm at a portion thereof adjacent to the outer peripheral portion. The concave surface region is formed continuously with the convex surface region for supporting the diaphragm at a portion thereof adjacent to the center point. Curvatures of the convex surface region and the concave surface region are the same.

The present invention provides the following second feature. A diaphragm unit includes a diaphragm and a diaphragm case. The diaphragm has a center point and an outer peripheral portion. The diaphragm case includes a fixing surface and a regulating surface. The fixing surface supports the diaphragm at the outer peripheral portion thereof, thereby defining a fluid chamber and a back pressure chamber in the diaphragm case such that the diaphragm functions as a boundary. Inflow of fluid into the fluid chamber and outflow of the fluid from the fluid chamber are accomplished as the diaphragm is deformed in accordance with variation of pressure differential between the fluid chamber and the back pressure chamber. The regulating surface forms an inner surface for at least one of the fluid chamber and the back pressure chamber, thereby providing a limit of deformation of the diaphragm. The regulating surface has a convex surface region and a concave surface region. The convex surface region is formed continuously with the fixing surface for supporting the diaphragm at a portion thereof adjacent to the outer peripheral portion. The concave surface region is formed continuously with the convex surface region for supporting the diaphragm at a portion thereof adjacent to the center point. Curvatures of the convex surface region and the concave surface region are the same.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments, together with the accompanying drawing, in which:

DETAILED DESCRIPTION OF THE PREFERRED EMBODIMENTS

Figure 1:
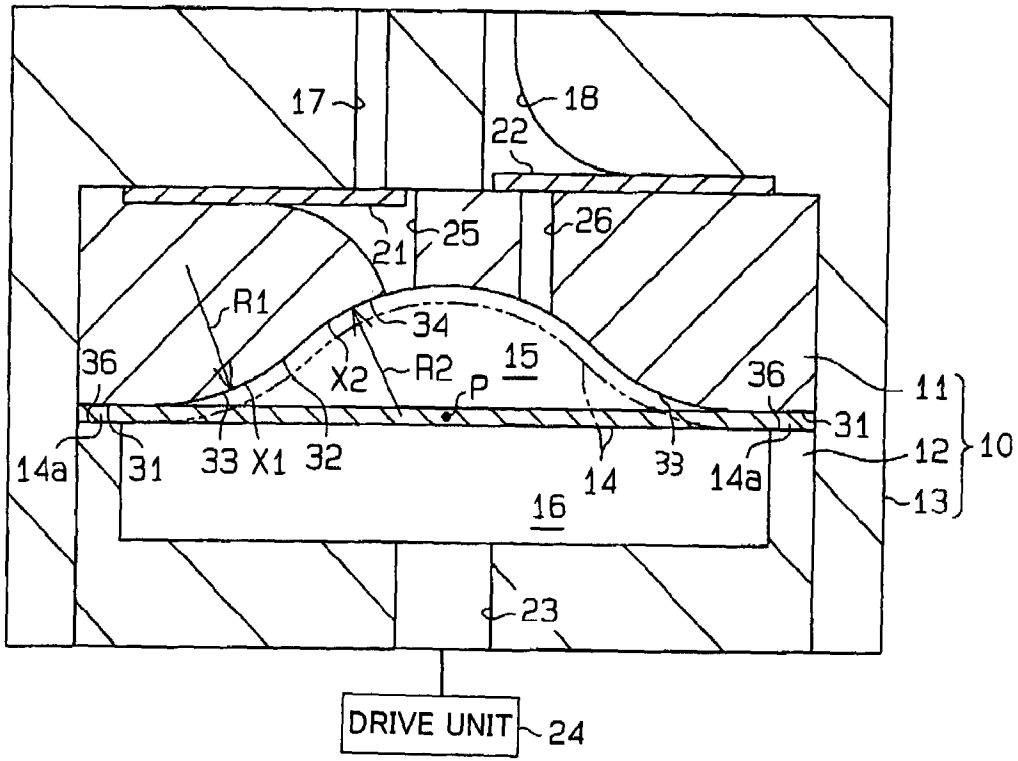
FIG. 1 is a longitudinal sectional view illustrating a diaphragm pump according to a preferred embodiment of the present invention.

A diaphragm unit according to a preferred embodiment of the present invention will now be described with reference to FIG. 1. The present embodiment shows an example wherein the diaphragm unit is applied to a diaphragm pump which is adapted for feeding gas.

FIG. 1 shows a longitudinal sectional view of a diaphragm pump. As shown in FIG. 1, the diaphragm pump has a diaphragm case 10 which includes a first case 11, a second case 12 which is fixedly joined to the first case 11, and a body case 13 in which the first and second cases 11, 12 are accommodated. The body case 13 is formed in a cylindrical cover shape with the cover portion thereof located on the upside as seen in FIG. 1. The first and second cases 11, 12 are received in the body case 13 such that the first case 11 is located on the cover side.

The first case 11 and the second case 12 have defined therebetween a space which is divided into a fluid chamber 15 on the side of the first case 11 and a back pressure chamber 16 on the side of the second case 12 by a diaphragm 14 which is interposed between the first case 11 and the second case 12. The diaphragm 14 is made of metallic material and has a circular shape. The first and second cases 11, 12 support the diaphragm 14 so as to permit the deformation (displacement) of the diaphragm 14 by holding an annular region of the outer peripheral portion 14*a* of the diaphragm 14 at the joints of the first and second cases 11, 12, or between a fixing surface 31 of the first case 11 and a fixing surface 36 of the second case 12 which faces the fixing surface 31.

The body case 13 has formed therein a suction passage 17 to which an external low-pressure piping (not shown) is connected, and a discharge passage 18 to which an external high-pressure piping (not shown) is connected. The first case 11 has formed in the middle thereof a suction port 25 which connects the fluid chamber 15 to the suction passage 17, and a discharge port 26 which connects the fluid chamber 15 to the discharge passage 18. A suction valve 21 in the form of a reed valve is provided between the suction port 25 in the first case 11 and the suction passage 17 in the body case 13. A discharge valve 22 in the form of a reed valve is provided between the discharge port 26 in the first case 11 and the discharge passage 18 in the body case 13.

The second case 12 has formed therein a passage 23 which connects the back pressure chamber 16 to an external drive unit 24 including a pressure supplying source (or high pressure region). The drive unit 24 connects the passage 23, or the back pressure chamber 16, alternatively to the pressure supplying source and a low pressure region, thereby increasing and decreasing the pressure in the back pressure chamber 16. For example, as the pressure in the back pressure chamber 16 increases, the pressure differential between the back pressure chamber 16 and the fluid chamber 15 increases, and the diaphragm 14 is elastically deformed toward the fluid chamber 15, thereby decreasing the volume of the fluid chamber 15. In contrast, as the pressure in the back pressure chamber 16 decreases, the pressure differential between the back pressure chamber 16 and the fluid chamber 15 decreases, and the diaphragm 14 tends to return to its natural state (or its flat state), thereby increasing the volume of the fluid chamber 15.

Therefore, during a suction process when the diaphragm 14 decreases the amount of its elastic deformation, gas is introduced from the suction passage 17 to the fluid chamber 15 while pushing open the suction valve 21. During a discharge process when the diaphragm 14 increases the amount of its elastic deformation, the gas in the fluid chamber 15 is discharged to the discharge passage 18 while pushing open the discharge valve 22. It is noted that, depending on the structure of the drive unit 24, that is, the pressure of the lower pressure region to which the back pressure chamber 16 is connected, the pressure in the back pressure chamber 16 may become lower than the pressure in the fluid chamber 15 in the suction process. In this case, the diaphragm 14 which has returned to the natural state in the suction process is further elastically deformed toward the back pressure chamber 16 to such an extent that the diaphragm 14 is located at the bottom dead center.

The first case 11 has a regulating surface 32 which forms an inner surface of the fluid chamber 15. The regulating surface 32 provides a limit of deformation toward the top dead center of the diaphragm 14. That is, as shown by chain double-dashed line in FIG. 1, in a case where the diaphragm 14 is deformed to be located at the top dead center where the volume of the fluid chamber 15 becomes substantially zero, substantially entire surface of the diaphragm 14 which faces the fluid chamber 15 is brought into contact with the regulating surface 32, thereby preventing the diaphragm 14 from being further elastically deformed.

The regulating surface 32 of the first case 11 includes a convex surface region 33 and a concave surface region 34. The convex surface region 33 is formed smoothly continuously with the fixing surface 31 such that the boundary therebetween forms no angle. The convex surface region 33 supports the deformed diaphragm 14 at a portion thereof adjacent to the outer peripheral portion 14*a*. The concave surface region 34 is formed smoothly continuously with the convex surface region 33 such that the boundary therebetween forms no angle. The concave surface region 34 supports the deformed diaphragm 14 at a portion thereof adjacent to a center point P of the diaphragm 14. The regulating surface 32 is formed such that each point in the concave surface region 34 exists in the identical convex spherical surface.

Therefore, even when the diaphragm 14 is located at the limit of its deformation toward the top dead center thereof and shaped to conform with the regulating surface 32, the vicinities of the boundaries between the fixing surface 31 and the regulating surface 32 and between the convex surface region 33 and the concave surface region 34 will have no angle of deflection, so that plastic deformation of the diaphragm 14 caused by deflection is prevented and reduction of the durability of the diaphragm 14 is prevented, accordingly.

In the present embodiment, the convex surface region 33 and the concave surface region 34 are formed such that curvatures thereof are the same. To be more specific, a curvature radius R1 of a curved line X1 for the convex surface region 33 and a curvature radius R2 of a curved line X2 for the concave surface region 34 as viewed on a plane which extends perpendicularly to the diaphragm 14 in its flat position and passes through the center point P of the diaphragm 14 (i.e. the plane of the drawing of FIG. 1), are the same.

Therefore, when the diaphragm 14 is located at the limit of its deformation toward the top dead center thereof, a part of the diaphragm 14 contacting either one of the convex surface region 33 and the concave surface region 34 is prevented from being bent with a greater curvature radius than the other part of the diaphragm 14 contacting the other of the convex surface region 33 and the concave surface region 34, thereby preventing stress caused by bending moment from being applied unevenly to the diaphragm 14 which is in contact with the regulating surface 32. Consequently, the durability of the diaphragm 14 is further improved.

It is noted that the following embodiments are also practicable without departing from the purpose of the invention.

In the above-mentioned embodiment, the regulating surface 32 is formed such that each point in the concave surface region 34 exists in the identical convex spherical surface. In an alternative embodiment to the preferred embodiment, the above structure is modified in such a manner that the regulating surface 32 has formed in the middle thereof a flat region and the concave surface region 34 is connected smoothly to the flat region.

In the diaphragm pump of the above-mentioned embodiment, the diaphragm 14 is deformed by positively increasing and decreasing the pressure in the back pressure chamber 16 and the volume of the fluid chamber 15 is varied accordingly, thus allowing the gas to flow into and to be discharged out of the fluid chamber 15. In an alternative embodiment to such preferred embodiment, the above structure is modified in such a manner that the back pressure chamber 16 and the drive unit 24 are eliminated from the diaphragm pump, and a rod is connected to the diaphragm 14 so that the diaphragm 14 is deformed by reciprocating the rod by a drive source such as motor and the volume of the fluid chamber 15 is varied accordingly, thereby allowing the gas to flow into and to be discharged out of the fluid chamber 15.

Although, in the above-mentioned embodiment the diaphragm unit of the present invention is applied to the diaphragm pump for handling the gas, the diaphragm unit of the present invention is not limited to such diaphragm pump, but it is applicable to a diaphragm pump for handling a liquid.

As indicated earlier in the "BACKGROUND OF THE INVENTION" herein, the diaphragm unit of the present invention may be applied to a diaphragm damper for use in a pulsation reduction device for reducing the pulsation of fuel supplied to an internal combustion engine.

In the above-mentioned preferred embodiment, the fluid chamber 15 has formed therein the regulating surface 32 which provides the limit of deformation of the diaphragm 14 toward the top dead center thereof. In an alternative embodiment to the preferred embodiment, an additional regulating surface is formed in the back pressure chamber 16 of the second case 12, which provides the limit of deformation of the diaphragm 14 toward the bottom dead center thereof. Like the regulating surface 32, the additional regulating surface also includes a convex surface region and a concave surface region. The convex surface region is formed continuously with the fixing surface 36 of the second case 12 to support the diaphragm 14 at a portion thereof adjacent to the outer peripheral portion 14*a*. The concave surface region is formed continuously with the convex surface region to support the diaphragm 14 at a portion thereof adjacent to the center point P. The convex surface region and the concave surface region are formed such that curvatures thereof are the same.

Therefore, the present examples and embodiments are to be considered as illustrative and not restrictive and the invention is not to be limited to the details given herein but may be modified.

What is claimed is:

1. A diaphragm unit comprising:

a diaphragm having a center point and an outer peripheral portion; and a diaphragm case comprising:

a fixing surface for supporting the diaphragm at the outer peripheral portion thereof, thereby defining a fluid chamber in the diaphragm case, inflow of fluid into the fluid chamber and outflow of the fluid from the fluid chamber being accomplished as the diaphragm is deformed; and a regulating surface for forming an inner surface of the fluid chamber, thereby providing a limit of deformation of the diaphragm, the regulating surface comprising:

a convex surface region formed continuously with the fixing surface for supporting the diaphragm at a portion thereof adjacent to the outer peripheral portion; and a concave surface region formed continuously with the convex surface region for supporting the diaphragm at a portion thereof adjacent to the center point, wherein curvatures of the convex surface region and the concave surface region are the same.

2. The diaphragm unit according to claim 1, wherein the diaphragm unit is a diaphragm pump.

3. A diaphragm unit comprising:

a diaphragm having a center point and an outer peripheral portion; and a diaphragm case comprising:

a fixing surface for supporting the diaphragm at the outer peripheral portion thereof, thereby defining a fluid chamber and a back pressure chamber in the diaphragm case such that the diaphragm functions as a boundary, inflow of fluid into the fluid chamber and outflow of the fluid from the fluid chamber being accomplished as the diaphragm is deformed in accordance with variation of pressure differential between the fluid chamber and the back pressure chamber; and a regulating surface for forming an inner surface for at least one of the fluid chamber and the back pressure chamber, thereby providing a limit of deformation of the diaphragm, the regulating surface comprising:

a convex surface region formed continuously with the fixing surface for supporting the diaphragm at a portion thereof adjacent to the outer peripheral portion; and a concave surface region formed continuously with the convex surface region for supporting the diaphragm at a portion thereof adjacent to the center point, wherein curvatures of the convex surface region and the concave surface region are the same.

4. The diaphragm unit according to claim 3, wherein the diaphragm unit is a diaphragm pump.

* * * * *